US009711087B2

(12) United States Patent
Choi et al.

(10) Patent No.: US 9,711,087 B2
(45) Date of Patent: Jul. 18, 2017

(54) PIXEL WITH MULTIPLE CAPACITORS AND ORGANIC LIGHT EMITTING DISPLAY

(71) Applicant: SAMSUNG DISPLAY CO., LTD., Yongin, Gyeonggi-Do (KR)

(72) Inventors: Jae-Beom Choi, Yongin (KR); Kwang-Hae Kim, Yongin (KR); Seong-Hyun Jin, Yongin (KR); Young-Jin Chang, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 185 days.

(21) Appl. No.: 14/256,125

(22) Filed: Apr. 18, 2014

(65) Prior Publication Data

US 2014/0320476 A1 Oct. 30, 2014

(30) Foreign Application Priority Data

Apr. 30, 2013 (KR) ..... 10-2013-0048156

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0852* (2013.01); *G09G 2300/0866* (2013.01)

(58) Field of Classification Search
CPC ... G09G 2300/0852; G09G 2300/0866; G09G 3/3233; G09G 3/3258
See application file for complete search history.

(56) References Cited

U.S. PATENT DOCUMENTS

2011/0050550 A1* 3/2011 Tsai ..... G09G 3/3233 345/76
2011/0193850 A1* 8/2011 Chung ..... G09G 3/3233 345/212
2012/0026146 A1* 2/2012 Kim ..... G09G 3/3233 345/211
2012/0105410 A1 5/2012 Choi et al.
2012/0113077 A1 5/2012 Kang

FOREIGN PATENT DOCUMENTS

KR 10-2012-0044504 5/2012
KR 10-2012-0048294 5/2012

* cited by examiner

*Primary Examiner* — Ram Mistry
(74) *Attorney, Agent, or Firm* — Lee & Morse P.C.

(57) ABSTRACT

A pixel includes an organic light emitting diode (OLED), a first transistor, a first capacitor, a second capacitor, and a pixel circuit. The OLED includes a cathode electrode connected to a second power source. The first transistor is connected between a data line and a first node, and turns on when a scan signal is supplied to a scan line. The first capacitor is connected between the first node and a third power source. The second capacitor is connected between the first node and a fourth power source. The pixel circuit controls a current quantity flowing from a first power source to the second power source through the OLED based on a voltage of the first node.

18 Claims, 6 Drawing Sheets

PIXEL WITH MULTIPLE CAPACITORS AND ORGANIC LIGHT EMITTING DISPLAY

CROSS-REFERENCE TO RELATED APPLICATION

Korean Patent Application No. 10-2013-0048156, filed on Apr. 30, 2013, and entitled, "Pixel And Organic Light Emitting Display Device Using The Same," is incorporated by reference herein in its entirety.

BACKGROUND

1. Field

One or more embodiments described herein relate to a display device.

2. Description of the Related Art

Various types of flat panel displays have been developed. Examples include liquid crystal displays, field emission displays, plasma display panels, and organic light emitting display devices. These displays are lighter than conventional displays that use cathode ray tubes.

Organic light emitting displays are of particular interest. These displays generate images using pixels that have organic light emitting diodes. Each diode generates light based on recombination of electrons and holes in an active layer. These displays have faster response speeds and lower power consumption compared to other displays.

SUMMARY

In accordance with one embodiment, a pixel includes an organic light emitting diode (OLED) including a cathode electrode connected to a second power source; a first transistor connected between a data line and a first node, the first transistor to turn on when a scan signal is supplied to a scan line; a first capacitor between the first node and a third power source; a second capacitor between the first node and a fourth power source; and a pixel circuit configured to control a current quantity flowing from a first power source to the second power source through the OLED based on a voltage of the first node. Voltages of the first and third power sources may be substantially equal, and voltages of the second and fourth power sources may be substantially equal.

The pixel circuit may include a third transistor between the first node and a third node, the third transistor having a turn-on period that does not overlap a turn-on period of the first transistor; a second transistor configured to control a current quantity flowing from the first power source to the OLED through a fourth node based on a voltage applied to the second node, the first power source connected to the third node; a fourth transistor between the second and fourth nodes, the fourth transistor turned on and off with the third transistor; and a storage capacitor between the second node and first power source.

The pixel circuit may include a fifth transistor between the second node and an initialization power source, the fifth transistor having a turn-on period that does not overlap turn-on periods of the first and third transistors; a sixth transistor between the third node and first power source, the sixth transistor turned on and off with the fifth transistor; a seventh transistor connected in parallel to the sixth transistor, the seventh transistor located between the third node and first power source and having a turn-on period that overlaps the turned-on period of the first transistor; and an eighth transistor between the fourth node and the OLED, the eighth transistor turned on and off with the seventh transistor.

In accordance with another embodiment, an organic light emitting display device includes pixels in respective regions divided by scan lines and data lines; a scan driver configured to drive the scan lines; and a data driver configured to drive the data lines, wherein each of the pixels in an ith horizontal line includes: n organic light emitting diode (OLED) having a cathode electrode connected to a second power source; a first transistor between a specific data line and a first node, the first transistor turned on when a scan signal is supplied to an ith scan line; a first capacitor between the first node and a third power source; a second capacitor between the first node and a fourth power source; and a pixel circuit configured to control a current quantity flowing to the second power source from a first power source through the OLED based on a voltage of the first node. Voltages of the first and third power sources may be substantially equal, and voltages of the second and fourth power sources may be substantially equal.

The display device may include a control driver configured to supply a first control signal to a first control line commonly connected with the pixels for a first period in one frame period, and to supply a second control signal to a second control line commonly connected with the pixels for a second period in one frame period.

The scan driver may sequentially supply a scan signal to the scan lines for a third period in one frame period, and to supply a light emission control signal to a light emission control line commonly connected with the pixels for the first period and a second period, and the data driver may supply a data signal to the data lines synchronized with the scan signals.

The pixel circuit may include a third transistor between the first node and a third node, the third transistor turned on when the second control signal is supplied; a second transistor configured to control a current quantity flowing from the first power source to the OLED through a fourth node based on a voltage of a second node, the first power source connected to the third node; a fourth transistor between the second and fourth nodes, the fourth transistor turned on when the second control signal is supplied; and a storage capacitor between the second node and first power source.

The pixel circuit may include a fifth transistor between the second node and an initialization power source, the fifth transistor turned on when the first control signal is supplied; a sixth transistor between the third node and first power source, the sixth transistor turned on when the first control signal is supplied; a seventh transistor connected in parallel to the sixth transistor, the seventh transistor between the third node and first power source and turned off when a light emission control signal is supplied to the light emission control line and turned on for one or more remaining periods; and an eighth transistor between the fourth node and the OLED, the eighth transistor turned on and off with the seventh transistor. A voltage of the initialization power source may be lower than a voltage of the data signal.

In accordance with another embodiment, a pixel includes a pixel circuit connected to a first node; a first capacitor between the first node and a first power source; and a second capacitor between the first node and a second power source, wherein the first capacitor reduces a voltage drop of the first power source and the second capacitor reduces a voltage drop of the second power source, and wherein the voltage drops of the first and second power sources are in opposite directions.

The voltage drop of the first power source may be substantially equal in magnitude to the voltage drop of the second power source. The voltage drop of the first power source and the voltage drop of the second power source may be based on a position of the pixel in a display device.

The first capacitor may reduce the voltage drop of the first power source and the second capacitor may reduce the voltage drop of the second power source by substantially equal amounts.

The pixel circuit may include an organic light emitting diode coupled between third and fourth power sources. Voltages of the first and third power sources may be substantially equal, and voltages of the second and fourth power sources may be substantially equal. The first node may be between the pixel circuit and a data line.

The pixel circuit may include a first switch between the first node and a node of a driving transistor. The pixel may include a second switch between the data line and the first node.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
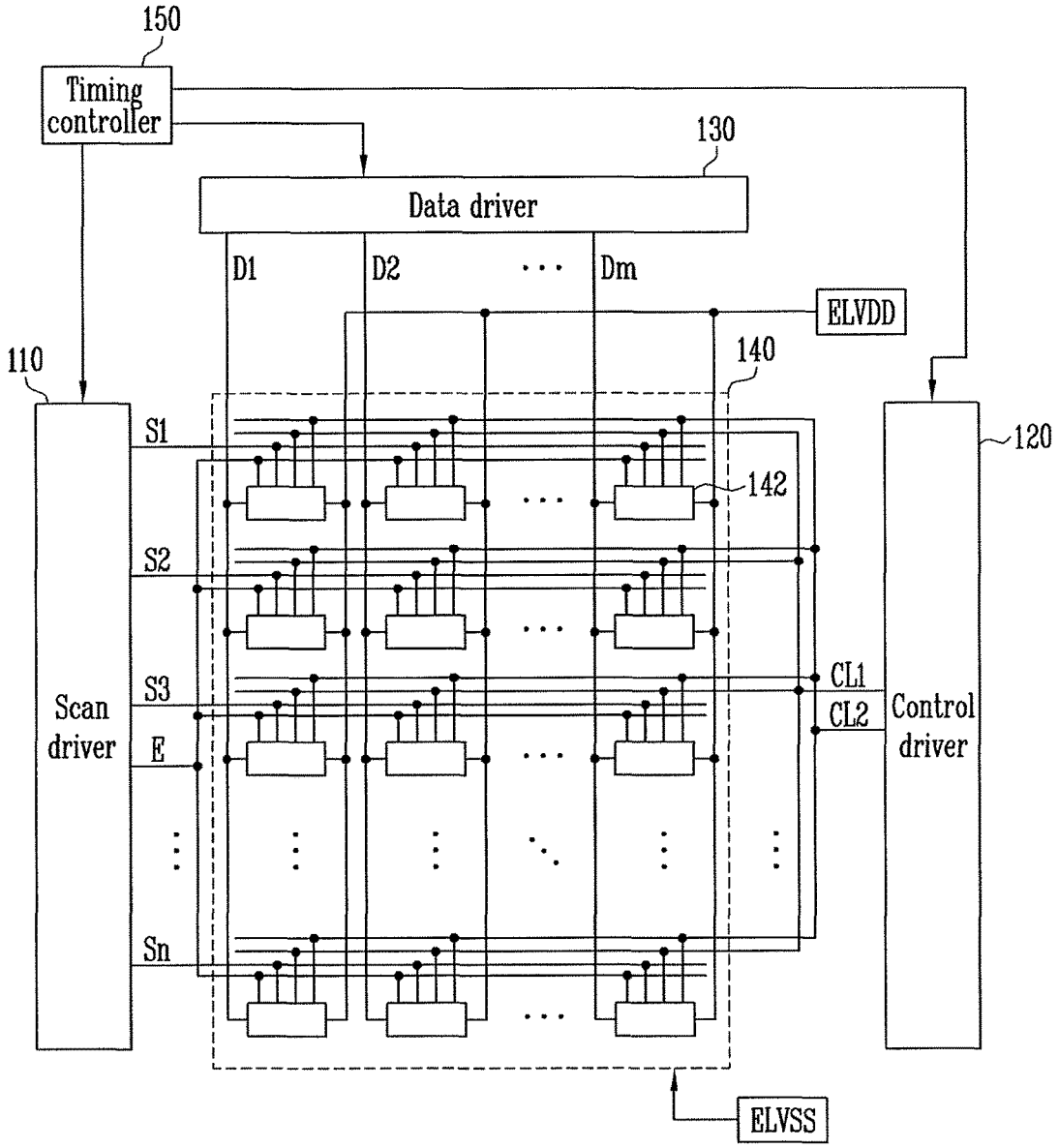
FIG. 1 illustrates an embodiment of an organic light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of an organic light emitting display device which includes a scan driver 110, a control driver 120, a data driver 130, a pixel unit 140, and a timing controller 150. The pixel unit 140 includes pixels 142 positioned in regions divided by a plurality of scan lines S1 to Sn and a plurality of data lines D1 to Dm. The scan driver 110 drives a light emission control line E commonly connected to the scan lines S1 to Sn and pixels 142. The control driver 120 drives a first control line CL1 and a second control line CL2 commonly connected to pixels 142. The data driver 130 drives data lines D1 to Dm. The timing controller 150 controls the drivers 110, 120, and 130.

The scan driver 110 sequentially supplies a scan signal to scan lines S1 to Sn for a period (e.g., a third period) in one frame period. When the scan signal is sequentially supplied to the scan lines S1 to Sn, pixels 142 are selected in units of horizontal lines. Further, scan driver 110 supplies a light emission control signal to the light emission control line E for a period (e.g., a first period and a second period), except the third period, in one frame period. The scan signal may be set to a voltage for turning on a transistor in each of pixels 142. The light emission control signal may be set to a voltage for turning off this transistor. Accordingly, pixels 142 are set to be in a non-emission state for the first period and second period, for which the light emission control signal is supplied to the light emission control line E.

The data driver 130 supplies data signals to data lines D1 to Dm synchronized with the scan signal. The data signal is supplied to pixels selected by the scan signal.

The control driver 120 supplies a first control signal to the first control line CL1 for the first period in one frame period, and supplies a second control signal to the second control line CL2 for the second period in one frame period. The first control signal and second control signal are voltages for turning on a transistor in each of the pixels 142.

The pixels 142 are located at crossing portions of the scan lines S1 to Sn and data lines D1 to Dm. The pixels 142 are initialized in the first period of one frame, and compensate for threshold voltages of the driving transistors in the second period. The pixels 142 include capacitors that charge voltages corresponding to the data signals. The pixels 142 emit light in the third period according to the charged voltages.

The pixels 142 simultaneously compensate for the threshold voltages of their driving transistors in the second period. When the threshold voltages are simultaneously compensated, it is possible to sufficiently secure the second period and thus to stably compensate for the threshold voltages of the driving transistors. That is, even in a case where the panel is driven at high speed (e.g., 120 Hz or more), it is possible to sufficiently secure the time of the second period, to thereby stably compensate for the threshold voltages of the driving transistors.

The pixels 142 are connected to respective scan lines S1 to Sn and data lines D1 to Dm. Each pixel 142 is also connected to first control line CL1, second control line CL2, and light emission control line E. In other embodiments, the signal lines connected to pixels 142 may be changed, for example, in accordance with a structure of a pixel circuit in each of the pixels 142.

Figure 2A:
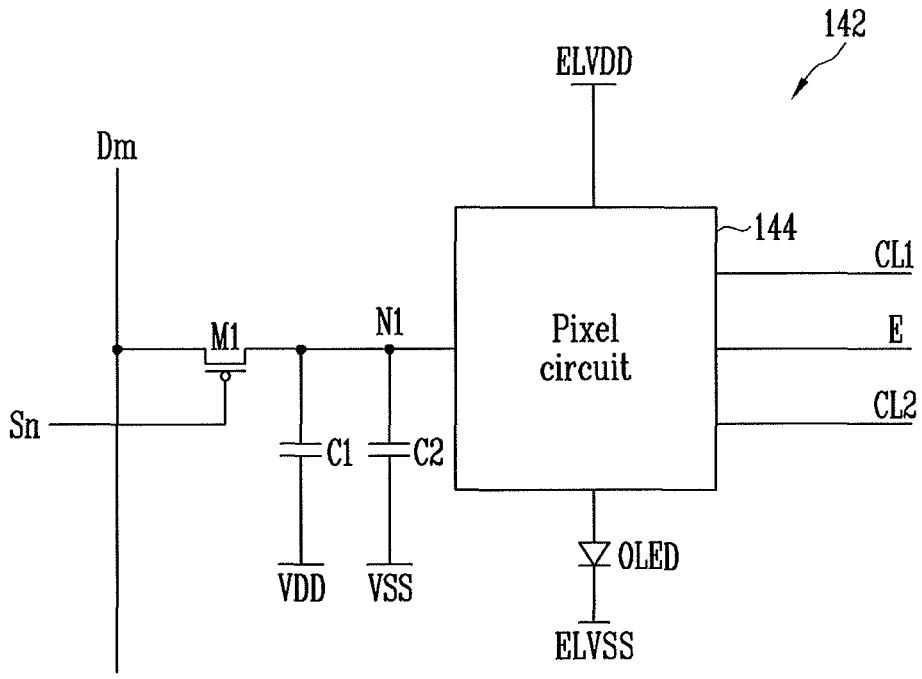
FIGS. 2A and 2B illustrate different embodiments of a pixel.
Figure 2B:
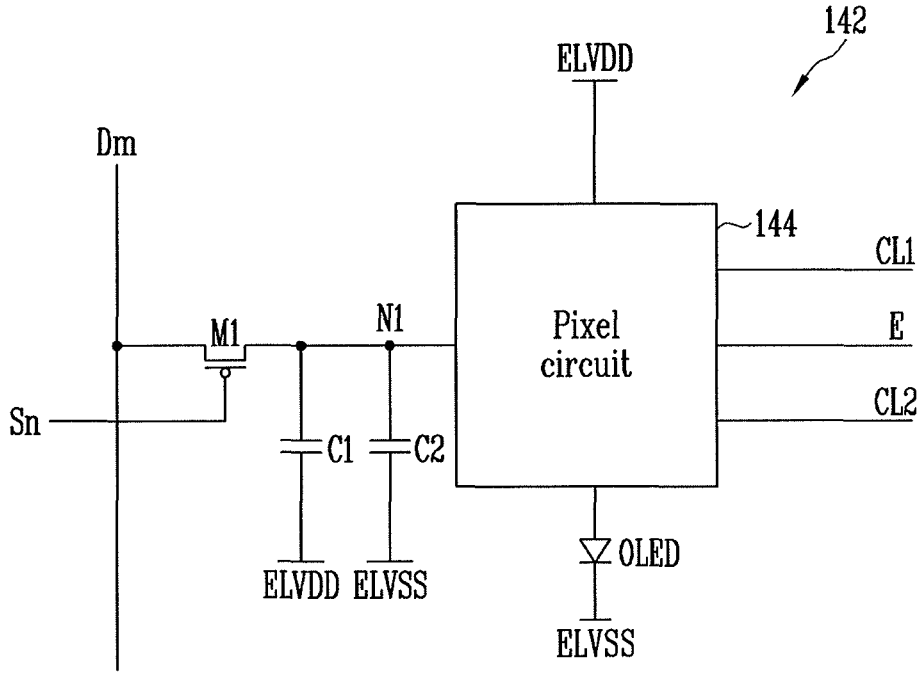

FIGS. 2A and 2B illustrate different embodiments of a pixel, which, for example may correspond to pixels 142 in FIG. 1. For illustrative purposes only, FIGS. 2A and 2B illustrate a pixel connected to an mth data line Dm and an nth scan line Sn.

Referring to FIGS. 2A and 2B, pixel 142 includes a first transistor M1, a first capacitor C1, a second capacitor C2, a pixel circuit 144, and an organic light emitting diode (OLED). An anode electrode of the OLED is connected to pixel circuit 144, and a cathode electrode of the OLED is connected to a second power source ELVSS. The OLED emits light with predetermined luminance based on an amount of current supplied from the pixel circuit 144.

The pixel circuit 144 charges an internal capacitor to a voltage based on voltages supplied from the first capacitor C1 and the second capacitor C2. The voltage may correspond to a data signal voltage. The pixel circuit 144 controls a current quantity supplied to the OLED from the first power source ELVDD in response to the charged voltage.

A first electrode of the first transistor M1 is connected to data line Dm. A second electrode of first transistor M1 is connected to a first node N1 connected to pixel circuit 144. A gate electrode of first transistor M1 is connected to scan line Sn. When the scan signal is supplied to scan line Sn, the first transistor M1 is turned on.

The first capacitor C1 is connected between the first node N1 and a third power source VDD, and stores (charges to) a voltage corresponding to the data signal.

The second capacitor C2 is connected between the first node N1 and a fourth power source VSS, and stored (charges to) a voltage corresponding to a data signal. The fourth power source Vss is different from the third power source VDD.

The third power source VDD may be selected as the first power source ELVDD, and the fourth power source VSS may be selected as the second power source ELVSS. When the third power source VDD is selected as the first power source ELVDD, and the fourth power source VSS is selected as the second power source ELVSS, it is possible to advantageously reduce power consumption and improve a display quality.

The first power source ELVDD and second power source ELVSS are connected to pixel 142. Accordingly, when the first capacitor C1 stores charge based on the first power source ELVDD and the second capacitor C2 storage charge based on the second power source ELVSS, separate additional wires may be omitted, thereby improving reliability. Further, when a separate wire is not added to each pixel 142, an area of the first power source ELVDD may be increased, thereby reducing or minimizing power consumption.

Figure 3:
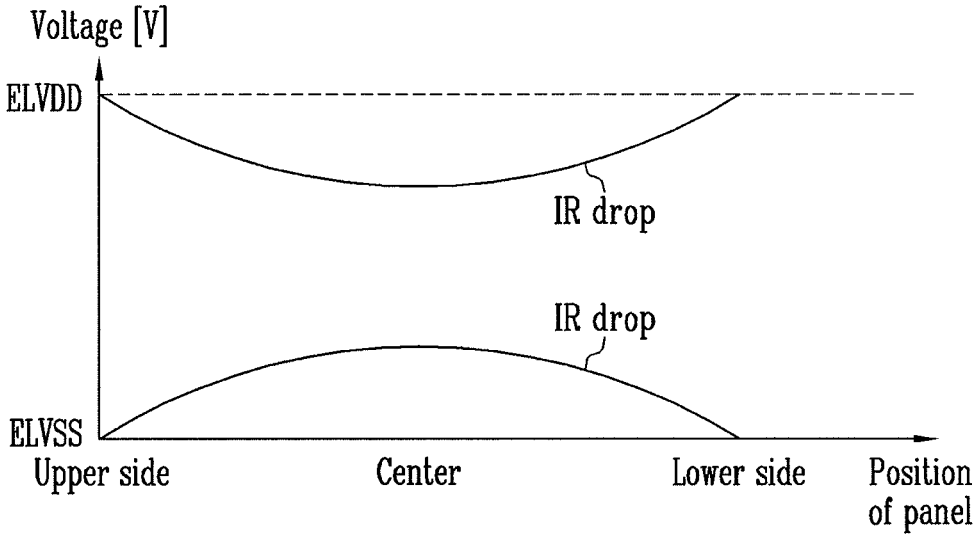
FIG. 3 illustrates voltage drops of different power sources.

In addition, when the first power source ELVDD and the second power source ELVSS are supplied from respective upper and lower sides of the panel, voltages of the first power source ELVDD and second power source ELVSS are different for each position of the panel due to voltage drop, as illustrated in FIG. 3.

For example, the voltage of the first power source ELVDD decreases in directions that extend from respective upper and lower sides of the panel to a center of the panel. Conversely, the voltage of the second power source ELVSS increases in directions that extends from respective upper and lower sides of the panel to the center of the panel. That is, the voltage of the first power source ELVDD that is a voltage decreases by a voltage drop, and the voltage of the second power source ELVDD that is a voltage increases by an amount that by substantially corresponds to the voltage drop. The first power source ELVDD may be greater than second power source ELVSS. In one embodiment, voltages of the first and second powers source may be both negative voltages or both positive voltages. In another embodiment, ELVDD may be a positive voltage and ELVSS a negative voltage.

In one embodiment, the first capacitor C1 is connected to the first power source ELVDD, and the second capacitor C2 is connected to the second power source ELVSS. In this case, the voltage drop of the first power source ELVDD and second power source ELVSS is uniform, on average, regardless of the position of pixel 142. Thus, it is possible to display an image with uniform luminance regardless of pixel position.

Figure 4:
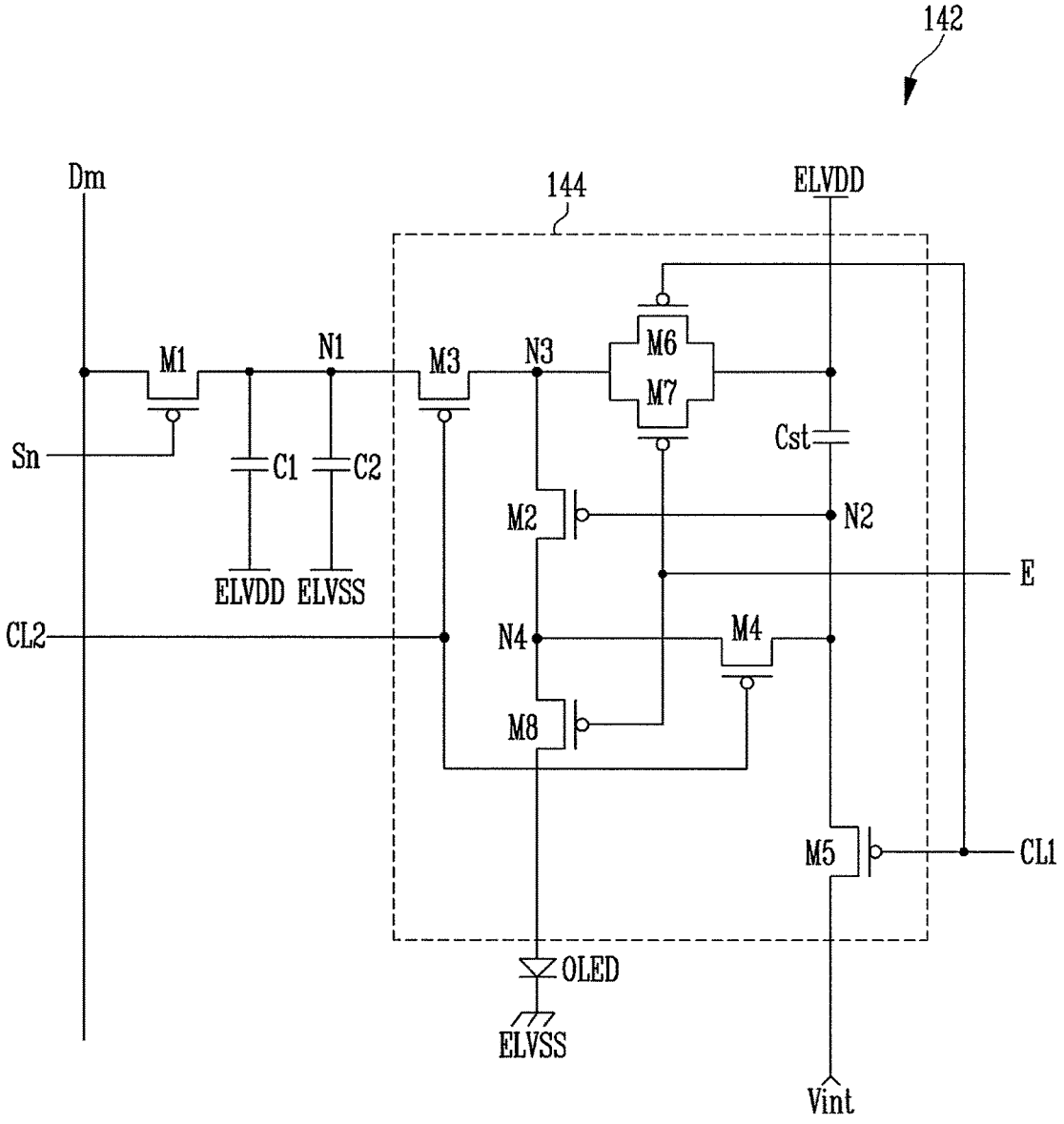
FIG. 4 illustrates an embodiment of a pixel circuit in FIG. 2A.

FIG. 4 illustrates an embodiment of pixel circuit 144 in FIG. 2A. Referring to FIG. 4, pixel circuit 144 includes second to eighth transistors M2 to M8 and a storage capacitor Cst.

A first electrode of the second transistor M2 (e.g., the driving transistor) is connected to a third node N3. A second electrode of the second transistor M2 is connected to a fourth node N4. A gate electrode of the second transistor M2 is connected to the second node N2. The second transistor M2 controls an amount of current supplied to the OLED in response to a voltage applied to the second node N2.

A first electrode of a third transistor M3 is connected to the first node N1. A second electrode of the third transistor M3 is connected to the third node N3. A gate electrode of the third transistor M3 is connected to the second control line CL2. The third transistor M3 is turned on when a second control signal is supplied to the second control line CL2, to electrically connect the first node N1 and third node N3.

A first electrode of a fourth transistor M4 is connected to a fourth node N4. A second electrode of the fourth transistor M4 is connected to the second node N2. A gate electrode of the fourth transistor M4 is connected to the second control line CL2. The fourth transistor M4 is turned on when the second control signal is supplied to the second control line CL2, to electrically connect the second node N2 and fourth node N4. When the second node N2 and fourth node N4 are electrically connected, the second transistor M2 is in a diode-connected state.

A first electrode of a fifth transistor M5 is connected to the second node N2. A second electrode is connected to an initialization power source Vint. A gate electrode of the fifth transistor M5 is connected to the first control line CL1. The fifth transistor M5 is turned on when the first control signal is supplied to the first control line CL1, to supply a voltage of the initialization power source Vint to second node N2. The initialization power source Vint may be set as a voltage lower than the data signal.

A first electrode of a sixth transistor M6 is connected to the first power source ELVDD. A second electrode of the sixth transistor M6 is connected to the third node N3. A gate electrode of the sixth transistor M6 is connected to the first control line CL1. The sixth transistor M6 is turned on when the first control signal is supplied to the first control line CL1, to supply a voltage of first power source ELVDD to third node N3.

A first electrode of a seventh transistor M7 is connected to the first power source ELVDD. A second electrode of the seventh transistor M7 is connected to the third node N3. A gate electrode of the seventh transistor M7 is connected to the light emission control line E. The seventh transistor M7 is turned off when the light emission control signal is supplied to the light emission control line E, and is turned on when the light emission control signal is not supplied.

A first electrode of an eighth transistor M8 is connected to the fourth node N4. A second electrode of the eighth transistor M8 is connected to the anode electrode of the OLED. A gate electrode of the eighth transistor M8 is connected to the light emission control line E. The eighth transistor M8 is turned off when the light emission control signal is supplied to the light emission control line E, and is turned on when the light emission control signal is not supplied.

The storage capacitor Cst is connected between the first power source ELVDD and second node N2. The storage capacitor Cst stores (charges to) voltages which correspond to the data signal and threshold voltage of second transistor M2, based on the voltages charged in the first capacitor C1 and second capacitor C2.

Figure 5:
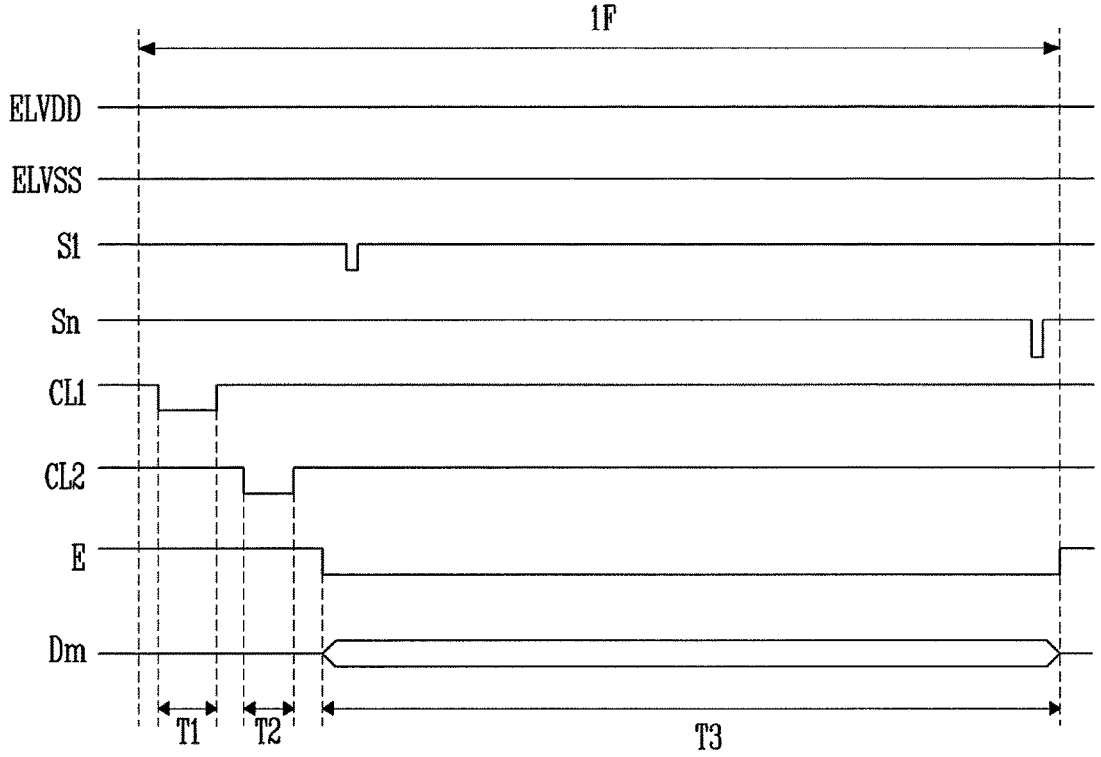
FIG. 5 illustrates an embodiment of a method for driving the pixel circuit.

FIG. 5 illustrates waveforms corresponding to an embodiment of a method for driving the pixel in FIG. 4. Referring to FIG. 5, one frame period is divided into a first period T1, a second period T2, and a third period T3. The first period includes an initialization period for supplying an initialization power source voltage Vint to second node N2. The second period T2 includes a compensation period for compensating the threshold voltage of second transistor M2. The third period T3 includes a light emission and data writing period, during which voltages corresponding to the data signal are charged in the first capacitor C1 and second capacitor C2 and during which the OLED simultaneously generates light with a luminance based on the data signal.

Referring to FIG. 5, the light emission control signal is supplied to the light emission control signal E for the first period T1 and second period T2. The light emission control signal is not supplied for the third period T3. When the light emission control signal is supplied to the light emission control signal E for the first period T1 and second period T2, the seventh transistor M7 and eighth transistor M8 are turned off. Then, an electrical connection between the second transistor M2 and the OLED is blocked. As a result, the organic light emitting diode OLED is set to be in a non-emission state for the first period T1 and second period T2.

The first control signal is supplied to the first control line CL1 for the first period T1. When the first control signal is supplied to the first control line CL1, the fifth transistor M5 and sixth transistor M6 are turned on. When the fifth transistor M5 is turned on, the initialization power source voltage Vint is supplied to second node N2. When the sixth transistor M6 is turned on, the first power source voltage ELVDD is supplied to third node N3. Because the initialization power source voltage Vint is lower than the data signal, the first transistor M1 is in an on-bias state for the first period T1.

The second control signal is supplied to the second control line CL2 for the second period T2. When the second control signal is supplied to the second control line CL2, the third transistor M3 and fourth transistor M4 are turned on.

When the fourth transistor M4 is turned on, the second transistor M2 is in a diode-connected state. When the third transistor M3 is turned on, the voltages stored in the first and second capacitors C1 and C2 are supplied to the third node N3. Because the voltage of the second node N2 is initialized to an initialization power source voltage Vint lower than the data signal, the second transistor M2 is turned on. When the second transistor M2 is turned on, the voltage applied to the third node N3 is supplied to the second node N2 through the second transistor M2 in the diode-connected state. In this case, the storage capacitor Cst stores the data signal and the voltage corresponding to the threshold voltage of the second transistor M2.

The supply of the light emission control signal to the light emission control line E is stopped for the third period T3. When the supply of the light emission control signal to the light emission control line E is stopped, the seventh transistor M7 and eighth transistor M8 are turned on. When the seventh transistor M7 is turned on, the first power source ELVDD and third node N3 are electrically connected. When the eighth transistor M8 is turned on, the fourth node N4 is electrically connected to the OLED. Then, the second transistor M2 controls an amount of current flowing to the second power source ELVSS from the first power source ELVDD through the OLED, in response to the voltage applied to the second node N2. The OLED generates light with a luminance based on the amount of supplied current.

The scan signal is sequentially supplied to scan lines S1 to Sn for the third period T3. When the scan signal is sequentially supplied to scan lines S1 to Sn, the first transistor M1 in each pixel 142 in a horizontal line unit is turned on. When the first transistor M1 is turned on, the data signal from a corresponding data line is supplied to the first node N1 in pixel 142. The first and second capacitors C1 and C2 are charged with voltages corresponding to the data signal. An image may be generated by repeating the aforementioned process for all the pixels in the display.

Figure 6:
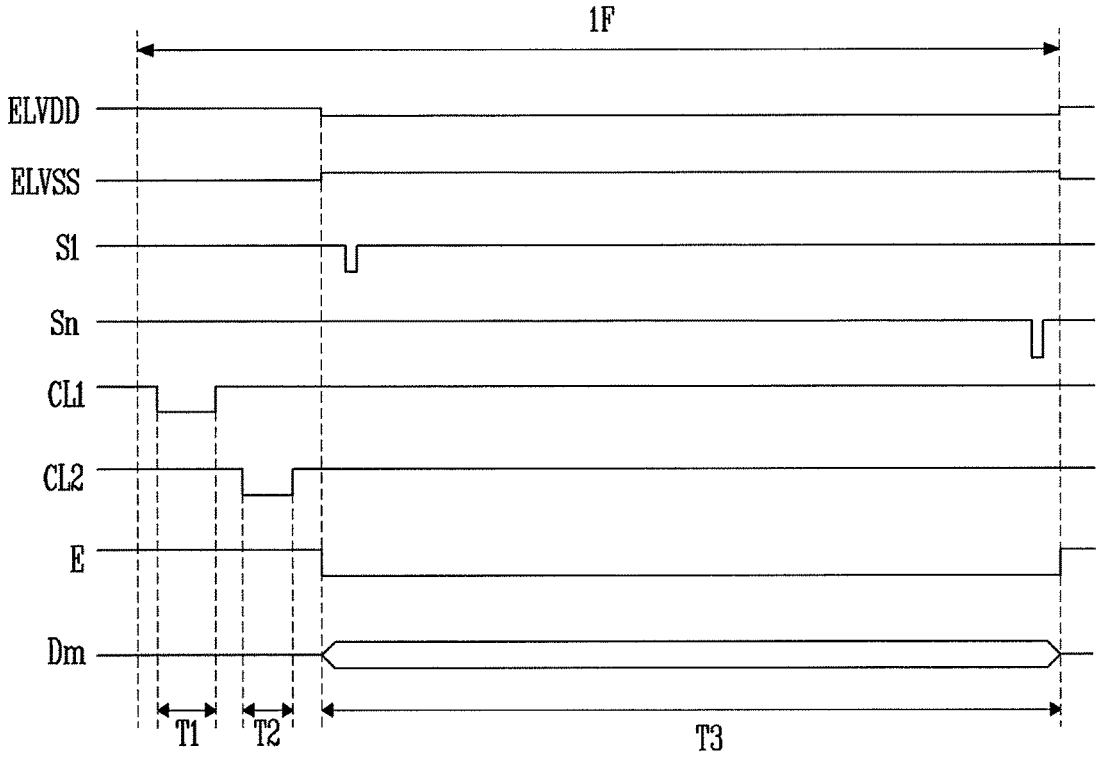
FIG. 6 illustrates voltage changes of different power sources in accordance with driving waveforms in FIG. 5.

Because pixels 142 emit light in the third period T3, the voltage of the first power source ELVDD is decreased by the voltage drop and the voltage of the second power source ELVSS is simultaneously increased as illustrated in FIG. 6. In this case, in each pixel 142, the voltage of the first node N1 is increased by the voltage stored in first capacitor C1, and the voltage of the second node N2 is decreased by a proportional amount by the voltage stored the second capacitor C2. Accordingly, in each pixel 142, the voltage of the first node N1 may maintain an average uniform voltage in response to a change in the voltages of the first power source ELVDD and the second power source ELVSS.

The transistors in the aforementioned embodiments are PMOS transistors. In other embodiments, NMOS transistors may be used.

Further, in at least one embodiment, the OLED generates red, green, or blue light having a gray scale value which corresponds to the current quantity supplied from the driving transistor. In other embodiments, the OLED may generate white light having a gray scale value which corresponds to the current quantity from the driving transistor. In this latter case, a color image may be implemented using one or more color filters.

By way of summation and review, one or more embodiments is directed to a pixel and an organic light emitting display device using the same in which a data signal is first charged by using the first capacitor and the second capacitor, and the charged data signals are simultaneously supplied to the pixel circuit. Thus, the threshold voltages of the pixels for a specific period of one frame may be simultaneously compensated and, accordingly, a period for compensating for the threshold voltage is sufficiently secured, thereby improving a display quality. To this end, in the exemplary embodiments of the present invention.

Further, one or more embodiments is directed to a pixel and an organic light emitting display device in which a first capacitor is formed using a first power source and second capacitor is formed using a second power source. In this case, a separate wire is not added, so that reliability may be improved and an area of the first power source may be increased, so that power consumption may be reduced. Further, voltages may be uniform, on average, due to the voltage drop of the first power source and the second power source, so that an image with uniform luminance maybe displayed.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A pixel, comprising:

an organic light emitting diode (OLED) including a cathode electrode connected to a second power source;

a first transistor connected between a data line and a first node, the first transistor to turn on when a scan signal is supplied to a scan line;

a first capacitor connected between the first node and a third power source and to be charged with a first charge based on a voltage difference between a data signal and the third power source through the first transistor when the first transistor is turned on;

a second capacitor connected between the first node and a fourth power source and to be charged with a second charge based on a voltage difference between the data signal and the fourth power source through the first transistor when the first transistor is turned on; and a pixel circuit including a second transistor, the second transistor to control a current quantity flowing from a first power source to the second power source through the OLED based on a voltage of the first node, wherein when the first and second capacitors are charging the first and second charges, the first and second capacitors are electrically disconnected from the second transistor.

2. The pixel as claimed in claim 1, wherein:

voltages of the first and third power sources are substantially equal, and voltages of the second and fourth power sources are substantially equal.

3. The pixel as claimed in claim 1, wherein:

the second transistor controls the current quantity flowing from the first power source to the OLED through a fourth node based on a voltage applied to a second node, and the pixel circuit further includes:

a third transistor between the first node and the third node, the third transistor having a turn-on period that does not overlap a turn-on period of the first transistor;

a fourth transistor between the second node and the fourth node, the fourth transistor turned on and off with the third transistor; and a storage capacitor between the second node and the first power source.

4. The pixel as claimed in claim 3, wherein the pixel circuit includes:

a fifth transistor between the second node and an initialization power source, the fifth transistor having a turn-on period that does not overlap turn-on periods of the first and third transistors;

a sixth transistor between the third node and first power source, the sixth transistor turned on and off with the fifth transistor;

a seventh transistor connected in parallel to the sixth transistor, the seventh transistor located between the third node and first power source and having a turn-on period that overlaps the turn-on period of the first transistor; and an eighth transistor between the fourth node and the OLED, the eighth transistor turned on and off with the seventh transistor.

5. An organic light emitting display device, comprising:

pixels in respective regions divided by scan lines and data lines;

a scan driver to drive the scan lines; and a data driver to drive the data lines, wherein each of the pixels in an ith horizontal line includes:

an organic light emitting diode (OLED) having a cathode electrode connected to a second power source;

a first transistor between a specific data line and a first node, the first transistor turned on when a scan signal is supplied to an ith scan line;

a first capacitor connected between the first node and a third power source and to be charged with a first charge based on a voltage difference between a data signal and the third power source through the first transistor when the first transistor is turned on;

a second capacitor connected between the first node and a fourth power source and to be charged with a second charge based on a voltage difference between the data signal and the fourth power source through the first transistor when the first transistor is turned on; and a pixel circuit including a -second transistor, the second transistor to control a current quantity flowing to the second power source from a first power source through the OLED based on a voltage of the first node, wherein when the first and second capacitors are charging the first and second charges, the first and second capacitors are electrically disconnected from the second transistor.

6. The display device as claimed in claim 5, wherein:

voltages of the first and third power sources are substantially equal, and voltages of the second and fourth power sources are substantially equal.

7. The display device as claimed in claim 5, further comprising:

a control driver to supply a first control signal to a first control line commonly connected with the pixels for a first period in one frame period, and to supply a second control signal to a second control line commonly connected with the pixels for a second period in one frame period.

8. The display device as claimed in claim 7, wherein:

the scan driver is to sequentially supply a scan signal to the scan lines for a third period in one frame period, and to supply a light emission control signal to a light emission control line commonly connected with the pixels for the first period and a second period, and the data driver is to supply a data signal to the data lines synchronized with the scan signals.

9. The display device as claimed in claim 8, wherein:

the second transistor controls the current quantity flowing from the first power source to the OLED through a fourth node based on a voltage applied to a second node, and the pixel circuit further includes:

a third transistor between the first node and the third node, the third transistor turned on when the second control signal is supplied;

a fourth transistor between the second and fourth nodes, the fourth transistor turned on when the second control signal is supplied; and a storage capacitor between the second node and the first power source.

10. The display device as claimed in claim 9, wherein the pixel circuit includes:

a fifth transistor between the second node and an initialization power source, the fifth transistor turned on when the first control signal is supplied;

a sixth transistor between the third node and first power source, the sixth transistor turned on when the first control signal is supplied;

a seventh transistor connected in parallel to the sixth transistor, the seventh transistor between the third node and first power source and turned off when a light emission control signal is supplied to the light emission control line and turned on for one or more remaining periods; and an eighth transistor between the fourth node and the OLED, the eighth transistor turned on and off with the seventh transistor.

11. The display device as claimed in claim 10, wherein a voltage of the initialization power source is lower than a voltage of the data signal.

12. A pixel, comprising:

a pixel circuit connected to a first node and having a third transistor and a driving transistor, the third transistor between the first node and the driving transistor, the driving transistor to control a current quantity flowing in a light emitter based on a data signal;

a first transistor connected between a data line and the first node, the first transistor to turn on when a scan signal is supplied to a scan line;

a first capacitor connected between the first node and a first power source and to be charged with a first charge based on the data signal and the first power source through the first transistor when the first transistor is turned on; and a second capacitor connected between the first node and a second power source to be charged with a second charge based on the data signal and the second power source through the first transistor when the first transistor is turned on, wherein the first and second charges stored in the first and second capacitors are to control the a same light emitter, wherein the first capacitor reduces a voltage drop of the first power source and the second capacitor reduces a voltage drop of the second power source, wherein the voltage drops of the first and second power sources are in opposite directions, and wherein:

the first node is connected to a source electrode or a drain electrode of the third transistor, and the first and second capacitors are electrically disconnected from the driving transistor by the third transistor being turned off when the first and second capacitors are charging the first and second charges.

13. The pixel as claimed in claim 12, wherein the voltage drop of the first power source is substantially equal in magnitude to the voltage drop of the second power source.

14. The pixel as claimed in claim 13, wherein the first capacitor reduces the voltage drop of the first power source and the second capacitor reduces the voltage drop of the second power source by substantially equal amounts.

15. The pixel as claimed in claim 12, wherein the light emitter includes an organic light emitting diode coupled between third and fourth power sources.

16. The pixel as claimed in claim 15, wherein:

voltages of the first and third power sources are substantially equal, and voltages of the second and fourth power sources are substantially equal.

17. The pixel as claimed in claim 12, wherein the first node is between the pixel circuit and the data line.

18. The pixel as claimed in claim 12, wherein the voltage drop of the first power source and the voltage drop of the second power source are based on a position of the pixel in a display device.

* * * * *